United States Patent [19]

Owens

[11] 4,365,677

[45] * Dec. 28, 1982

[54] EARTH BORING APPARATUS

[75] Inventor: Lloyd J. Owens, Seattle, Wash.

[73] Assignee: The Robbins Company, Kent, Wash.

[ * ] Notice: The portion of the term of this patent subsequent to Jun. 2, 1998, has been disclaimed.

[21] Appl. No.: 246,375

[22] Filed: Mar. 23, 1981

Related U.S. Application Data

[62] Division of Ser. No. 31,856, Apr. 20, 1979, Pat. No. 4,270,618.

[51] Int. Cl.[3] ..... E21C 9/00

[52] U.S. Cl. ..... 175/173; 175/53; 175/325

[58] Field of Search ..... 175/53, 171, 325, 272, 175/342, 173; 308/4 A

[56] References Cited

U.S. PATENT DOCUMENTS

| | | | |
|---|---|---|---|
| 1,317,192 | 9/1919 | Jones . | |
| 1,402,786 | 1/1922 | Muehl . | |
| 1,498,463 | 6/1924 | McCloskey et al. . | |
| 1,499,938 | 7/1924 | Leedom . | |
| 1,561,523 | 11/1925 | Riedle . | |
| 1,618,294 | 2/1927 | Olson . | |
| 2,139,323 | 12/1938 | Zum-Berge . | |
| 2,203,246 | 6/1940 | Zum-Berge . | |
| 2,783,974 | 3/1957 | Veasman . | |
| 2,799,475 | 7/1957 | Harlan et al. . | |
| 2,868,510 | 1/1959 | Dean . | |
| 2,886,288 | 5/1959 | Gehrke . | |
| 3,112,802 | 12/1963 | Amann et al. . | |
| 3,231,029 | 1/1966 | Winberg . | |
| 3,280,416 | 10/1966 | Forsyth . | |
| 3,302,983 | 2/1967 | Garrett | 175/325 |
| 3,599,734 | 8/1971 | Farris . | |
| 3,757,876 | 11/1973 | Pereau . | |
| 3,858,667 | 1/1975 | Goodfellow . | |
| 4,010,808 | 3/1977 | Youngblood | 175/342 |
| 4,102,413 | 7/1978 | Johnston | 175/53 |
| 4,270,618 | 6/1981 | Owens . | |

FOREIGN PATENT DOCUMENTS 628051 7/1961 Canada .

*Primary Examiner*—William F. Pate, III
*Attorney, Agent, or Firm*—Graybeal & Uhlir

[57] ABSTRACT

Large hole boring equipment is used for boring a large diameter blind pilot hole. Then such equipment is removed from the hole and a room is blasted at the closed or blind end of the hole. Then the large hole cutterhead is replaced by a reamer and the equipment is inserted back into the hole. The reamer is an adjustable diameter type and its diameter is increased once it is within such room. A wrench carried by a drive head of a drilling machine is used to rotate a small diameter shaft which extends downwardly through the drill string to a lead screw which is a part of the reamer. Rotation of the lead screw causes axial travel of a lead nut. As the lead nut travels it moves a plurality of links which in turn swing a plurality of cutter carrying arms outwardly from the axis of rotation. Once the desired fly diameter of the reamer is achieved, the wrench is removed from the drive head, then the small diameter shaft is locked against additional rotation, and the drive head is drivingly attached to the upper end of the drill string so that it can be used for rotating the drill string and the reamer attached thereto.

8 Claims, 25 Drawing Figures

DM
30
44
34
48
42
46
32
28
54
64
52
6
6
w
w
w
24
26
22
w
w
4
4
12
40
14
20
20
20
3
3
38
16
16
16
2
2
50
10
16
16
16
16
16
16
16
16
16
16
16
16
16
16
16
16
16
16
16
16
16
10
50

20
20
20
36
38
20
20
36
TW
20
20
20

EARTH BORING APPARATUS

CROSS REFERENCE TO RELATED APPLICATION

This is a divisional of my copending U.S. patent application Ser. No. 31,856, filed Apr. 20, 1979, and entitled Earth Boring Apparatus, now U.S. Pat. No. 4,270,618.

TECHNICAL FIELD

The present invention relates to earth boring apparatus. More particularly, it relates to mechanism for boring a large diameter hole from an upper level down to a lower level and to an expandable reamer for enlarging said hole to yet a larger diameter.

BACKGROUND ART

It is known to locate a drilling machine at an upper level and use it for first drilling a small pilot hole on a single downward pass, followed by an enlargement of the pilot hole in a single upward pass. Such a machine is disclosed by U.S. Pat. No. 3,220,494, granted Nov. 30, 1965, to Robert E. Cannon, Douglas F. Winberg, Dean K. McCurdy and Richard J. Robbins.

It is also known to use a drilling machine located at an upper level to bore a large diameter hole in a single downward pass. Examples of this type of equipment are disclosed by U.S. Pat. No. 3,383,946, granted May 21, 1968, to Carl L. Lichte and William M. Conn; by U.S. Pat. No. 3,648,788, granted Mar. 14, 1972, to John R. McKinney; by U.S. Pat. No. 3,762,486, granted Oct. 2, 1973, to William W. Grovengurg and Robert R. Gatliff.

The following patents disclose several types of known (at least in the patent literature) expandable reamers:

U.S. Pat. No. 1,317,192, granted Sept. 30, 1919, to Arthur S. Jones; U.S. Pat. No. 1,402,786, granted Jan. 10, 1922 to W. F. Muehl; U.S. Pat. No. 1,498,463, granted Oct. 26, 1922 to J. P. McCloskey et al; U.S. Pat. No. 1,499,938 granted July 1, 1924 to R. Leedom; U.S. Pat. No. 1,561,523 granted Nov. 17, 1925 to A. W. Riedle; U.S. Pat. No. 1,618,294, granted Feb. 22, 1927 to J. Olson; U.S. Pat. No. 2,139,323 granted Dec. 6, 1938 to E. H. Zum-Berge; U.S. Pat. No. 2,799,475, granted July 16, 1957 to D. L. Harlan et al; U.S. Pat. No. 2,868,510, granted Jan. 13, 1959 to C. A. Dean; U.S. Pat. No. 3,112,802, granted Dec. 3, 1963 to G. W. Amann et al; U.S. Pat. No. 3,757,876, granted Sept. 11, 1973 to Robert L. Pereau; and Canadian Pat. No. 632,051, granted July 4, 1961, to Austen M. Shook.

SUMMARY AND DESCRIPTION OF THE INVENTION

One aspect of the invention is to provide a stabilizer frame which includes a plurality of bore wall engaging rollers at its periphery. A drive stem is attachable to the stabilizer frame. The drive stem projects axially from said frame and includes means for detachably connecting it to a drill string. A bore forming cutterhead and a bore enlarging reamer are selectively detachably connectable to the stabilizer frame, at the end thereof opposite the drill stem.

Another aspect of the invention is to provide an adjustable diameter reamer for enlarging a preexisting bore hole in a ground formation, of a type which is remotely adjustable by rotation of a wrench at the drilling machine.

According to an aspect of the invention, the adjustable diameter reamer comprises a plurality of cutter support arms, each having a leading end which is pivotally connected to a frame portion of the reamer. Cutter means are provided on each of the support arms. The reamer frame includes a trailing portion in the nature of an axially extending guide beam. A slide ring is mounted for travel axially along the guide beam. The cutter arms are braced by means of positioning links which are interconnected between the cutter arms and the slide ring. Each cutter arm positioning link is pivotally connected at one of its ends to one of the cutter support arms and at its opposite end to the slide ring. A lead screw is housed within the reamer frame. It includes means mounting it for rotation about an axis coincident with the bore hole axis. A drive nut is mounted for travel along the lead screw. Tie means connect the drive nut to the slide ring so that they move together. A drill stem is connected to the reamer frame opposite the guide beam. It includes a rotatable drive rod means inside of it which when rotated turns the lead screw, so as to move the drive nut axially. This in turn causes the slide ring to move axially, causing an angular movement of the cutter arm positioning of the cutter support arms relative to the body. In this manner the fly diameter of the reamer is changed.

According to another aspect of the invention, a wrench is provided for rotating a sectional drive rod means which is located within the drill stem and a drill string which extends from the drill stem up to the drive head of the drilling machine. The wrench is connectable to the drive head, so that the drive mechanism for the drive head can be used for producing the rotary movement which causes adjustment of the cutter carrying arms, and hence the fly diameter, of the reamer.

The claims are to be taken as descriptions of additional aspects of the invention.

These and other objects, features, characteristics and advantages pertaining to and inherent in the present invention will be apparent from the following description of a typical and therefore non-limitive embodiment of the invention, as illustrated in the accompanying drawings, wherein like numerals refer to like parts, and wherein.

DESCRIPTION OF THE PREFERRED EMBODIMENT AND BEST MODE

The down drill assembly shown by FIGS. 1–6 comprises a down drill cutterhead 10 which is bolted or otherwise detachably connected to the frame 12 of a stabilizer 14.

Figures 1, 2, 3:
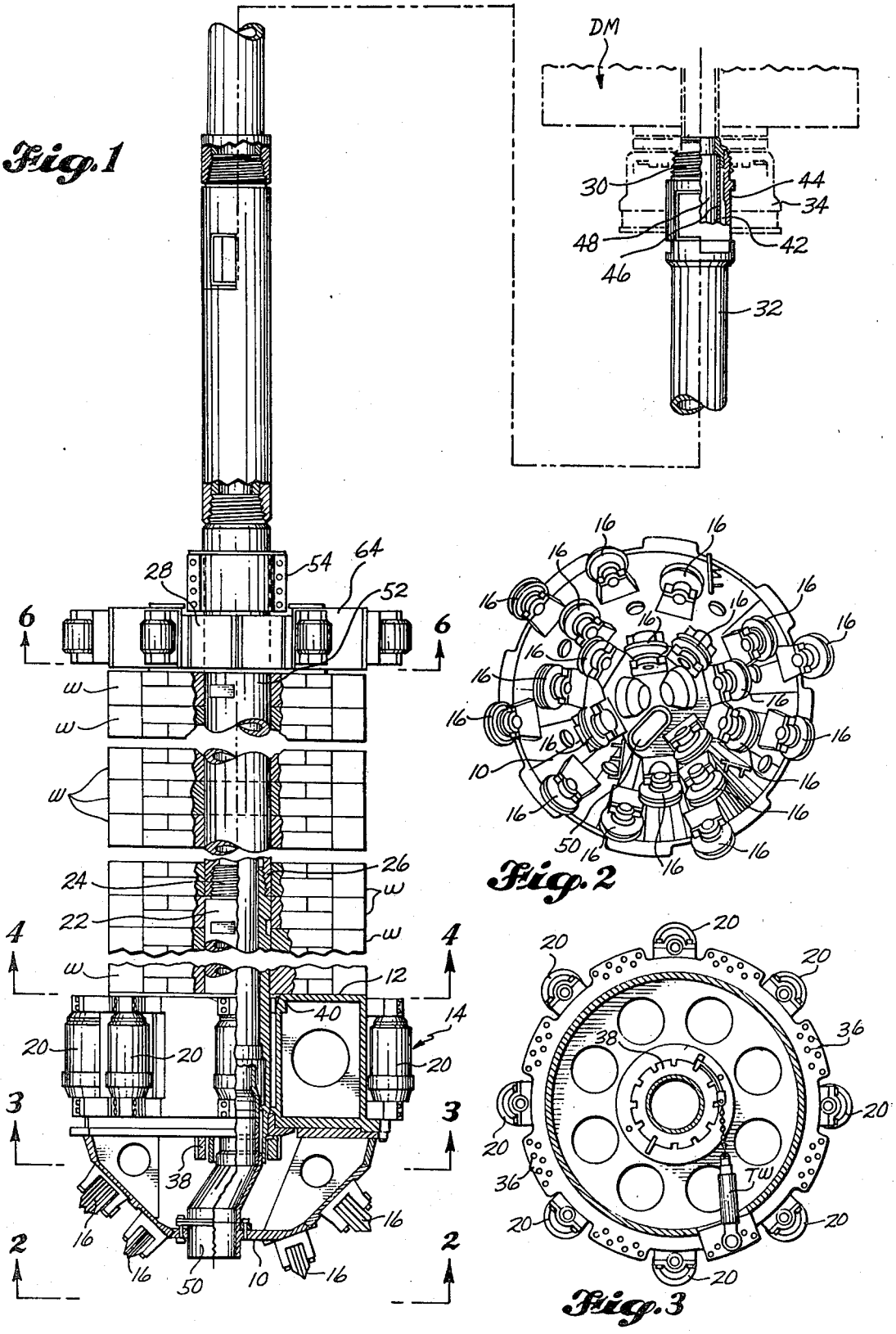
FIG. 1 is an elevational view of down hole drilling equipment, with some parts shown in section, with the drill string being broken away to indicate indeterminate length, and with the drive head portion of a drilling machine being shown in an offset position and in phantom.
FIG. 2 is a bottom plan view taken substantially from the aspect of line 2—2 of FIG. 1.
FIG. 3 is a cross-sectional view taken substantially along line 3—3 of FIG. 1, showing a torquing wrench installed.
Figure 4:
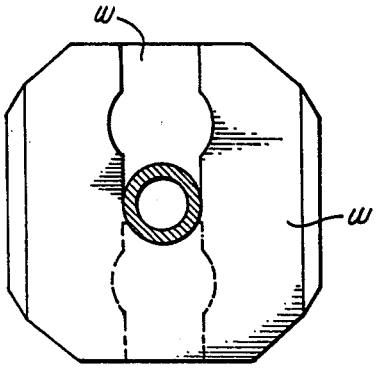
FIG. 4 is a sectional view, taken substantially along line 4—4 in FIG. 1.

As best shown by FIGS. 1 and 2, the cutterhead 10 carries a plurality of roller type cutters which may be disc cutters 16 as shown. The stabilizer 14 may include a plurality of bore wall contacting rollers 20. A drill stem or stinger 22 projects upwardly from the stabilizer frame 12. It includes a threaded tool joint component (i.e. a pin 24) adapted for thread engagement or connection with a complementary tool joint component (i.e. a box 26) located at the lower end of a section of drill pipe above it.

As is well known in the big hole down drilling art, a plurality of weights W are stacked on top of the stabilizer frame 12. Such weights W are used because the weight of the drill string itself is insufficient to provide the backup force on the cutters 16 which is necessary to make them penetrate into the earth material being bored.

The drill string includes a plurality of stabilizers 28 which are spaced apart in appropriate intervals along the drill string. The upwardly directed tool joint component 30 on the upper end of the uppermost section 32 of the drill string is threaded into a complementary tool joint component which forms a part of the drive head assembly 34 of a surface stationed drilling machine DM which is like or similar to the machine disclosed by the aforementioned U.S. Pat. No. 3,220,494.

As best shown by FIGS. 1 and 3, the cutterhead 10 may be removeably secured to the stabilizer frame 12 by means of a plurality of bolts, some of which are designated 36. The drill stem 22 may be secured in place by a large nut 38 and a wedge ring assembly 40, as will hereinafter be explained in more detail.

Figure 5:
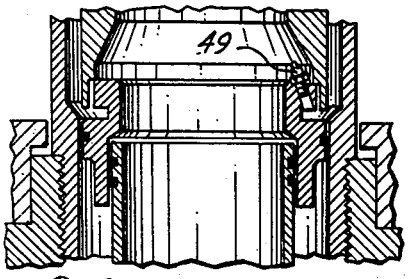
FIG. 5 is an enlarged scale fragmentary view of a jet lift portion of a muck tube.
Figure 6:
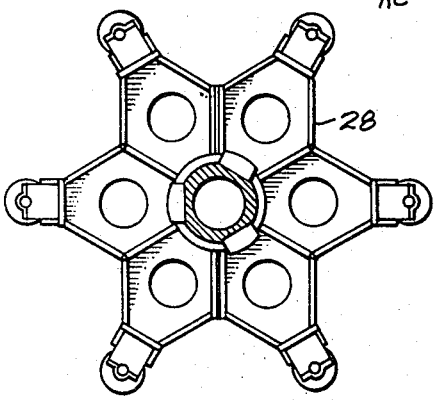
FIG. 6 is a cross-sectional view taken substantially along line 6—6 of FIG. 1.
Figure 7:
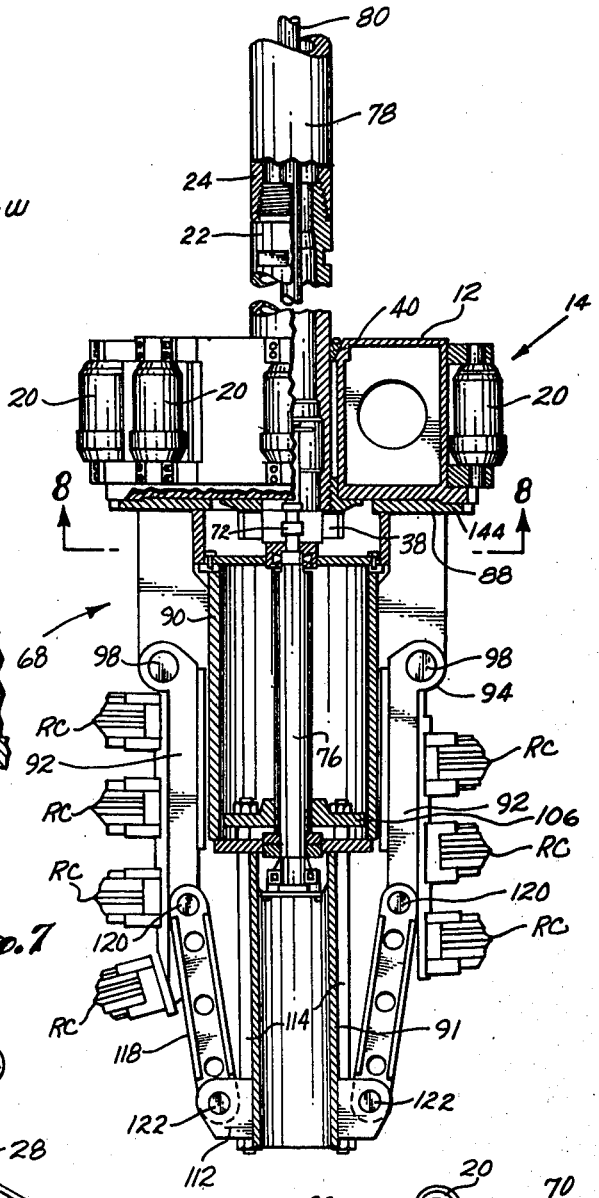
FIG. 7 is a fragmentary view of a collapsed adjustable reamer embodying features of the present invention with some parts being shown in elevation and others being shown in section.

The drill string is composed of sections or lengths of double walled drill pipe. Air is introduced downwardly through the annular space 42 (e.g. section 32 in FIG. 1) which is defined by and between the two walls 44, 46 of the drill pipe. The air is discharged into the central passageway 48 of the pipe by way of upwardly directed nozzles 49 (FIG. 5). The air stream so created induces an upward flow of water and cuttings, and it is in this manner that the cuttings are removed from the region of the cutterhead face. As shown by FIGS. 1 and 2, the cutterhead 10 includes a generally centrally located inlet 50 through which the cuttings and ground water enter.

Preparation for down drilling is as follows:

Firstly, drill stem 22 is inserted into the central opening in the stabilizer frame 12. Splines at the lower end of the stem 22 are engaged with splines which border the lower end of the central opening. The nut 38 (FIG. 3) is applied and tightened. A segmented wedge ring 40 is installed around the stem 38 at the upper end of the central opening. Next, the cutterhead frame 10 is bolted to the stabilizer frame 12. Then, the assembly is connected to the drilling machine DM. The machine DM is operated to lower such assembly. The weights W, a mandrel, or drill string composed of sections of drill pipe 52, a stabilizer 28, a clamp 54 and additional lengths of drill pipe are added, as the assembly is lowered, until drilling depth is reached. At that time a muck tube coupling is inserted.

The assembly of the reamer 68 onto the drill string will now be described:

The stabilizers, weights, spacers, etc. are all removed and the drill pipe sections are uncoupled. The drill stem 22 and the down drill cutterhead 10 are both removed from the stabilizer frame 12. Stem 22, nut 38, and wedge ring 40 are cleaned and lubricated for reassembly.

Figure 8:
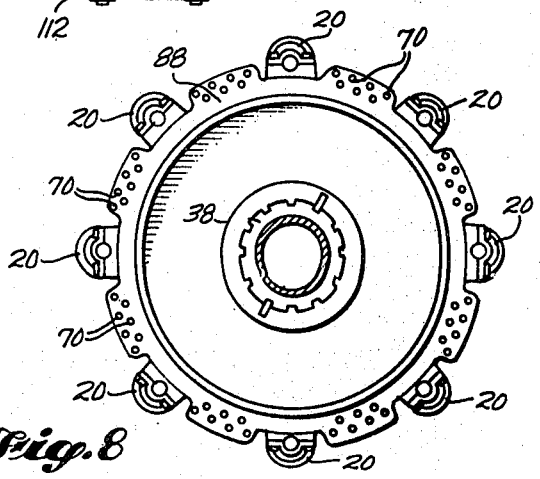
FIG. 8 is a cross-sectional view taken substantially along line 8—8 of FIG. 7.
Figure 16:
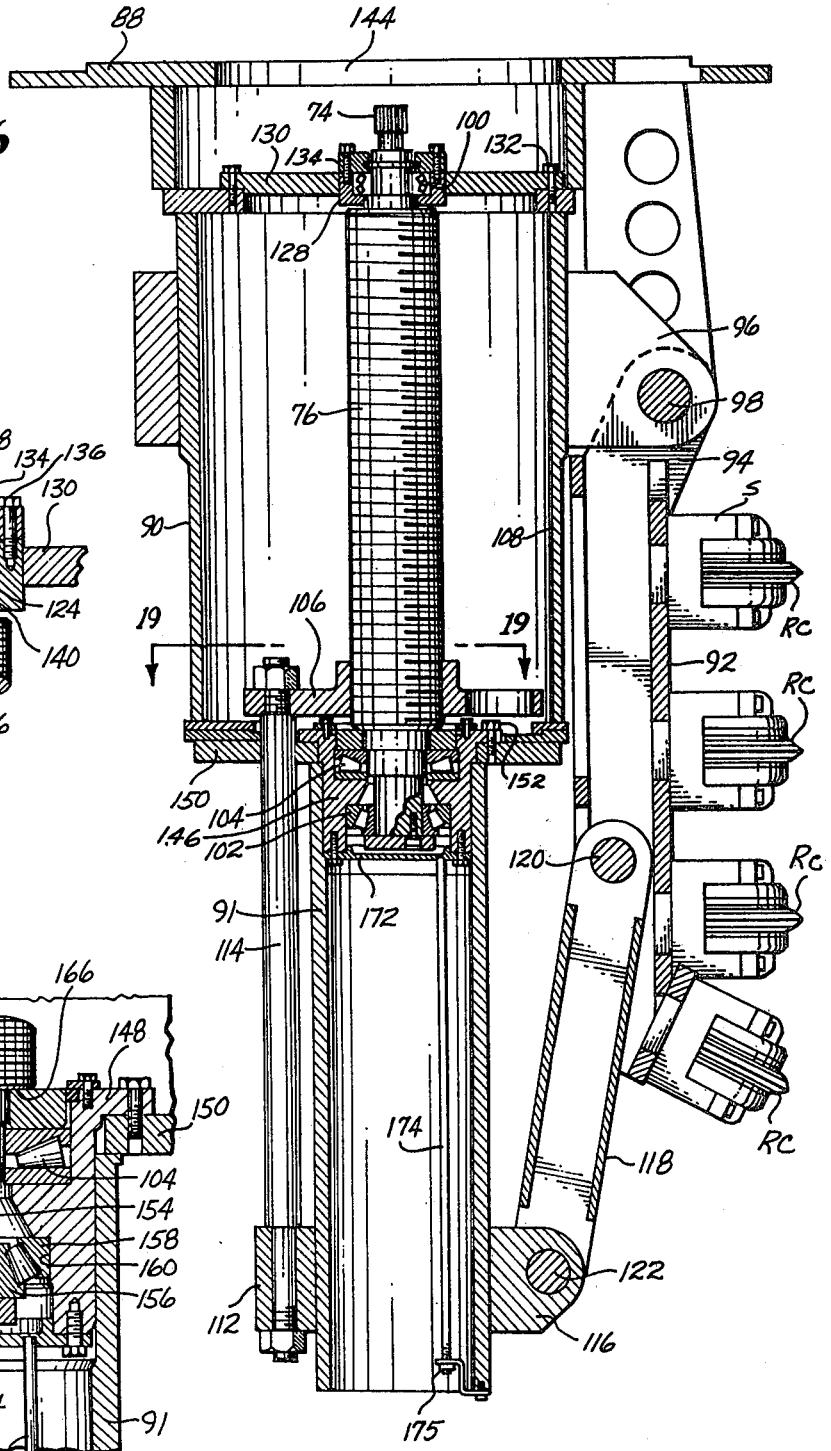
FIG. 16 is an enlarged scale fragmentary view of a portion of the expandable reamer, showing mechanism for positioning and structuraly bracing the cutter carrying arms.

Stem 22 is reassembled into the stabilizer frame 12, as before. The lock nut 38 is applied and is torqued into place by a hydraulic torquing wrench TW. Also, the wedge collar segments are installed. Next, a reamer body 68 is bolted to the stabilizer frame 12, such as by means of bolts 70 (FIG. 8). Then, a quill shaft starter 72 is installed into the stem 22 and splines at its lower end are moved into engagement with complementary splines 74 (FIG. 16) at the upper end of a lead screw 76. A mandrel 78 in the form of a section of drill pipe is installed on the stem 22 and a quill shaft 80 is located inside of mandrel 78. Additional mandrels 78 are added and every other one is provided with a stabilizer 82.

Figure 11:
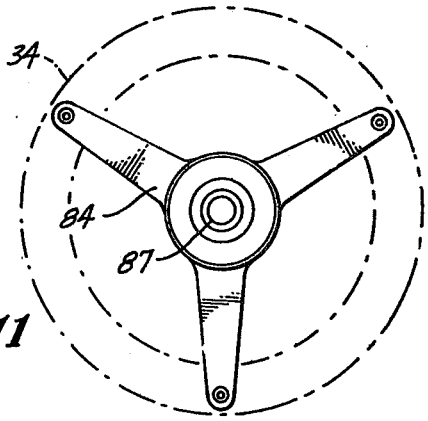
FIG. 11 is a plan view of an adaptor for the drive head, taken substantially from the aspect indicated by line 11—11 in FIG. 9.

As the reamer assembly is lowered into the previously bored hole, additional drill pipe sections and quill shafts 80 are installed. A quill shaft wrench 84 (FIG. 11) is bolted to the drive head 34 of the drilling machine. Then, the drive head 34 is lowered until a socket portion 87 of the wrench 84 has made engagement (RG threaded mating) with the upper end of a nipple which is a part of the quill shaft section 80. Then, the drive head 34 is rotated to turn the quill shaft to in that manner adjust the fly diameter of the cutter carrying arms 92 of the reamer 68.

Referring to FIGS. 7 and 14–19, the reamer 68 is shown to include a mounting plate 88 at its upper or leading end, by which it is attached to the lower portion of the stabilizer frame 12. A lead screw housing 90 extends axially from the mounting plate 88. A plurality of cutter carrying arms 92 are pivotally attached at their leading ends to the lead screw housing 90. In preferred form, the cutter carrying arms 92 are in the nature of box beams having spaced apart apertured ears 94 at their leading ends. These ears 94 are received between apertured mounting ears 96 which are secured to side portions of the lead screw housing 90. Pivot pins 98 extend through the apertures to complete hinge joints.

The lead screw 76 is mounted for rotation by means of bearings 100, 102. In addition, a thrust bearing 104 is provided at the trailing end of the lead screw 76. A drive nut 106 is mounted for travel along the lead screw 76. It is braced against rotation by an elongated track 108 which is secured to a side wall portion of the lead screw housing 90 and is received within a slot 110 (FIG. 19) cut in a peripheral portion of the drive nut.

A slide ring 112 surrounds a guide shaft 91 extending axially downwardly from the lower end of lead screw housing 90. A plurality of tie rods or bolts 114 connect the slide ring 112 to the lead nut 106.

Slide ring 112 includes radially outwardly extending ears 116, equaling the cutter mounting arms 92 in number. Brace links 118 extend between the mounting ears 116 and intermediate portions of the cutter mounting arms 92. Cross pins 120, 122 pivotally connect the ends of the links 118 to the arms 92 and the ears 116.

As best shown by FIGS. 20–24, each cutter carrying arm 92 carries a plurality of cutter mounting saddles S. The spacing of the saddles S is such that the roller cutters RC, positioned on the cutter carrying arms 92, cut concentric circles. The roller cutters RC have been assigned numbers RC 1–RC 18, to designate their position. Cutter number RC 1 is the innermost cutter and cutter number RC 18 is the outermost or gauge cutter. The relative spacing of the cutters is indicated by lines in FIGS. 20–24 having the same numbers as the cutters they relate to.

As will be apparent, when the lead screw 76 is rotated for advancing the drive nut 106, the slide ring 112 will move axially a corresponding amount due to its connection to the drive nut 106 by means of the rods 114. Sliding movement of ring 112 inwardly along shaft 91 causes a shortening of the distance between the pivot pins 98, 122. As a result, the angle between the links 118 and the cutter carrying arms 92 increases and the cutter carrying arms 92 swing outwardly, increasing the diameters of the circular paths of travel of the cutters RC.

Figure 18:
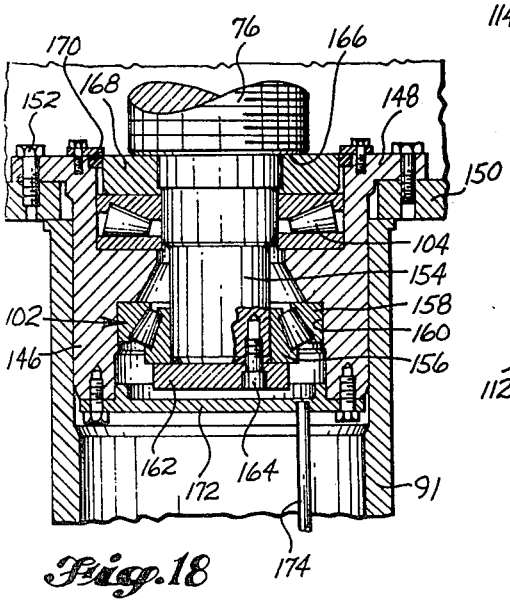
FIG. 18 is an enlarged scale fragmentary view of the lower end of the lead screw.
Figure 19:
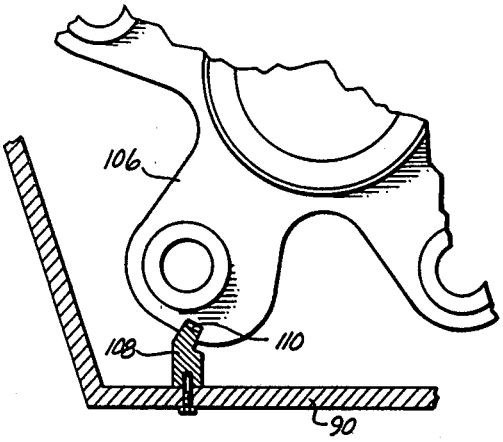
FIG. 19 is a fragmentary view of a mechanism provided for preventing unwanted rotation of the drive nut.
Figure 20:
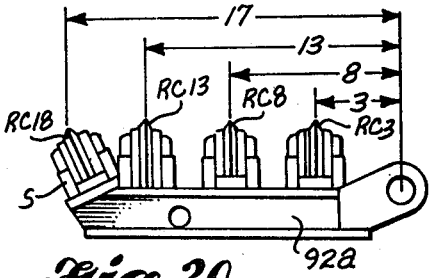
FIGS. 20–24 are five side-elevational views of the five cutter support arms and the cutter assemblies carried thereby.
Figure 21:
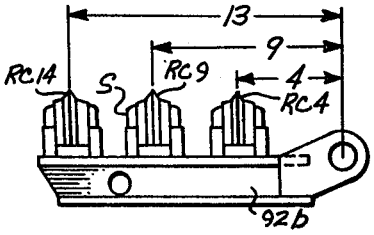
Figure 22:
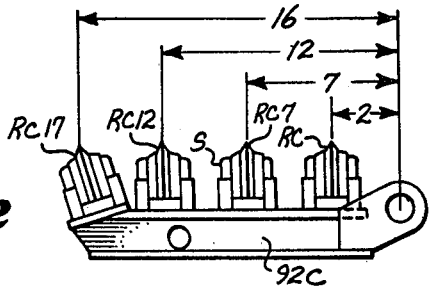

Referring to FIG. 18, thrust bearing housing 146 includes a radial flange 148 at its leading end which contacts the trailing end wall 150 of lead screw housing 90. Housing 146 is secured to end wall 150 by means of a plurality of bolts 152 which extend through openings in flange 148 and thread into tapped openings in the end wall 150. A reduced diameter end portion 154 of lead screw 76 fits inside of the inner race 156 of a cone bearing 102. The outer race 158 of bearing 102 is seated in a cup 160 that is a machined part of the housing 146. A bearing retainer plate 162 is bolted to the reduced diameter end portion 154 of the trailing end of lead screw 76 by means of belts 164.

A shoulder 166 at the trailing end of the threaded portion of lead screw 76 rests on an annular spacer 168 which in turn rests on thrust bearing 104. An annular seal 170 is bolted to the leading end of housing 146, to seal between housing 146 and the spacer 168.

A cover plate 172 is bolted or otherwise secured to the lower end of housing 146, to provide a lower closure for the bearing chamber.

One end of a grease delivery tube 174 extends through an opening in the cover plate 172. A grease gun receiving fitting 175 is provided at the opposite end of tube 174.

Figure 17:
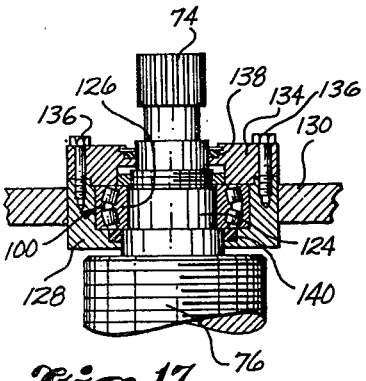
FIG. 17 is an enlarged scale fragmentary view at the upper end of the lead screw portion of the cutter arm positioning mechanism.

Referring to FIG. 17, a reduced diameter leading end portion 124 of the lead screw 76 is received within the inner race 126 of combination bearing 100. A seal retainer 128 is secured to a cover plate 130 which in turn is secured in place by a plurality of bolts 132. A bearing chamber cover 134 is secured to the bearing retainer 128, also by means of a plurality of bolts 136. Seals 138, 140 are provided at opposite ends of the bearing 100. The splined end portion 74 of the lead screw 76 projects into a space which is defined axially between cover 130 and mounting flange 88. A large dimension central opening 144 is provided in mounting flange 88, to serve in part, at least, as an access opening for reach of the bolts 132.

Figure 15:
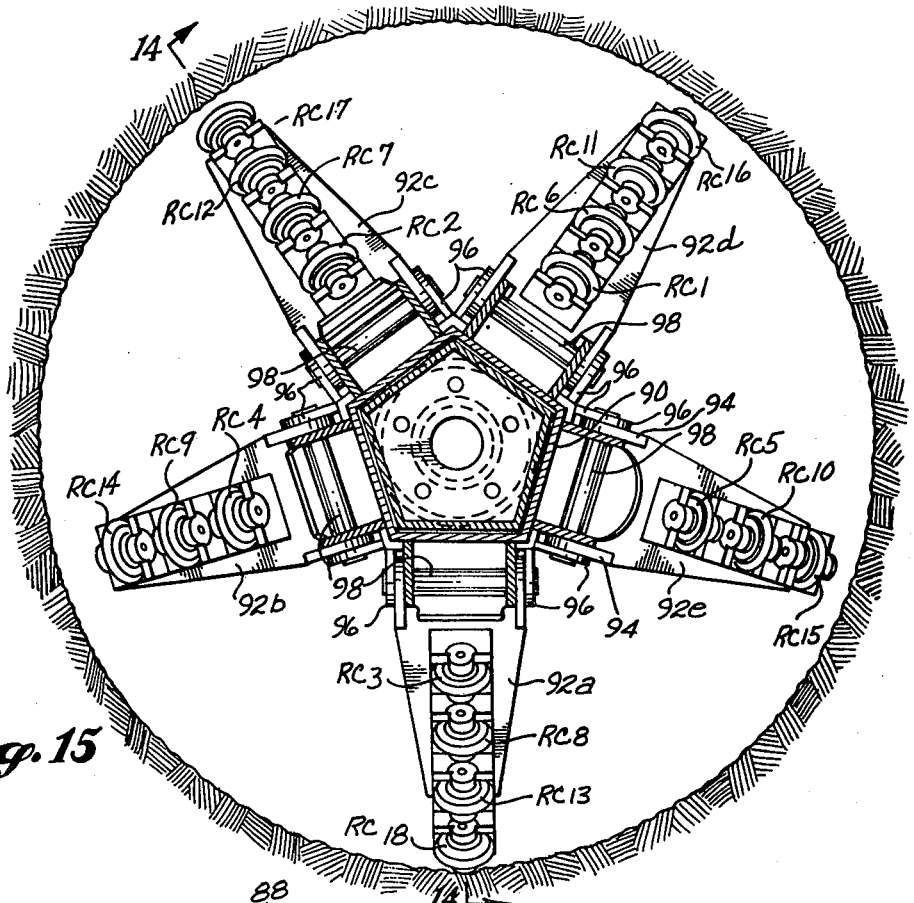
FIG. 15 is a sectional view of the reamer shown by FIG. 14, taken substantially along line 15—15 in FIG. 14, with some parts in top plan.
Figure 14:
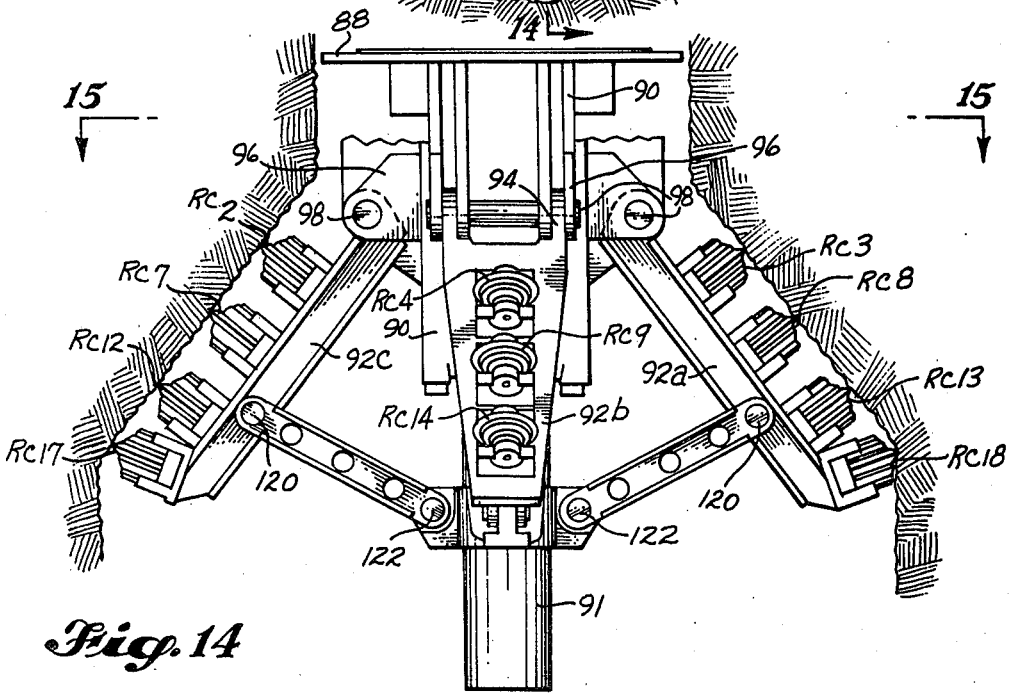
FIG. 14 is a fragmentary view of the lower portion of the reamer, shown in one of its expanded positions.
Figure 25:
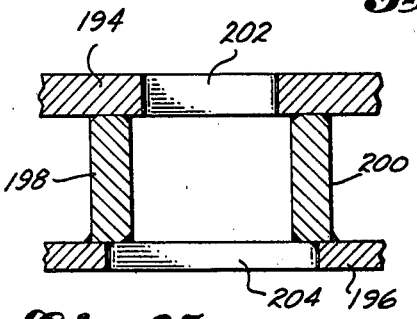
FIG. 25 is a cross-sectional view taken through a cutter support arm.
Figure 23:
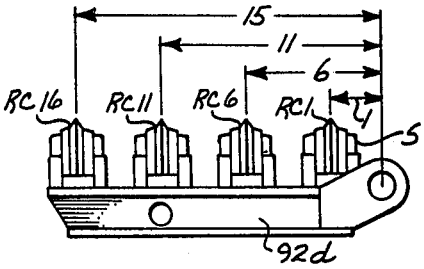
Figure 24:
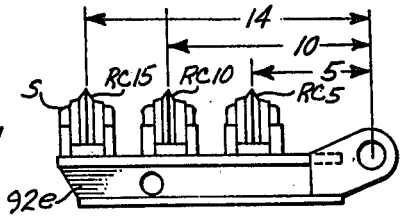

As shown by FIG. 25, the cutter carrying arms 92*a*, 92*b*, 92*c*, 92*d* and 92*e* are in the nature of composite box beams. Upper and lower plates 194, 196, the plan shape of which is shown by FIG. 15, are interconnected by means of a pair of side plates 198, 200. Muck passing openings 202, 204 are provided in the plates 194, 196.

Figure 9:
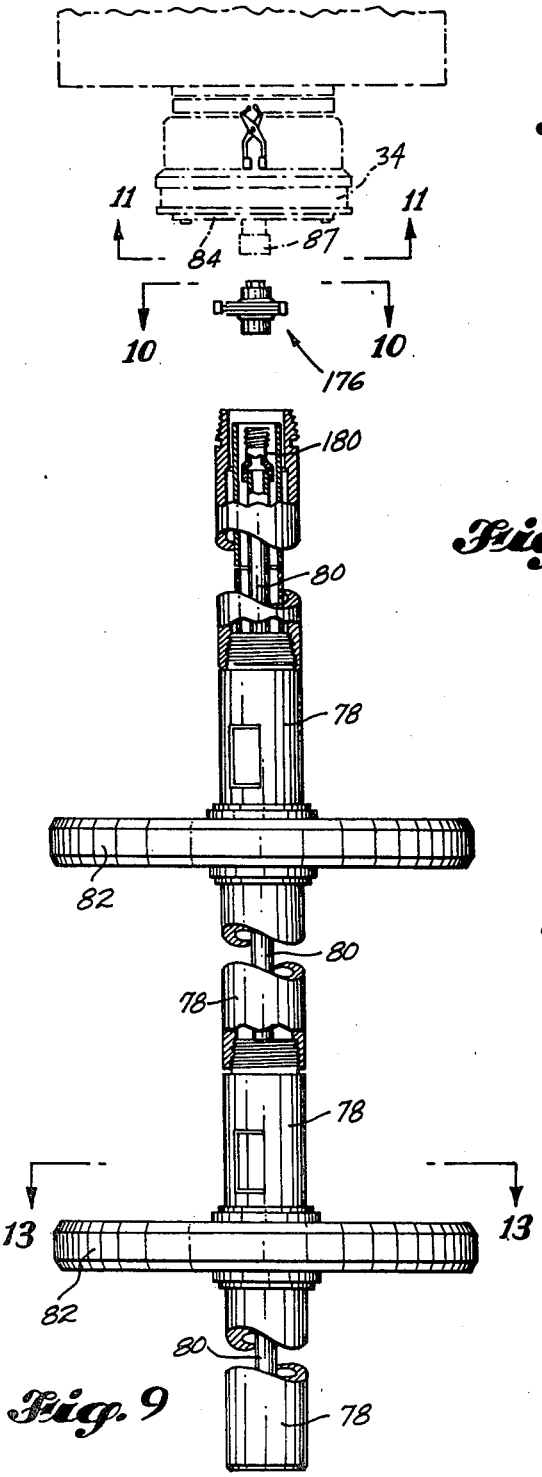
FIG. 9 is an elevational view of a drill string used for rotating and pulling the reamer, with some parts being cut away, such view including a phantom line showing of the drive head of a drilling machine.
Figure 10:
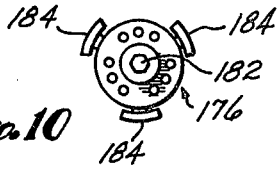
FIG. 10 is a plan view taken substantially from the aspect indicated by line 10—10 in FIG. 9.
Figure 12:
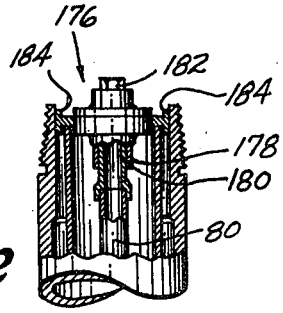
FIG. 12 is an enlarged scale fragmentary view at the upper end of an upper section of the drill string.
Figure 13:
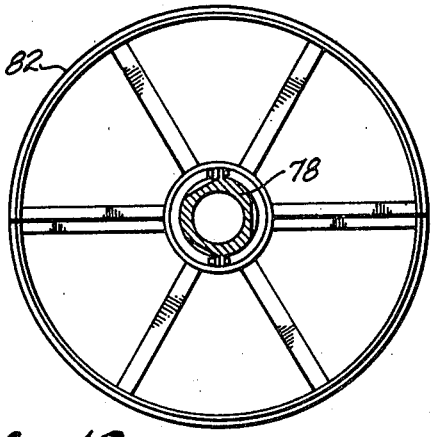
FIG. 13 is a cross-sectional view taken substantially along line 13—13 of FIG. 9.

Following use of the wrench 84 for adjusting the fly diameter of the cutter arms 92, and following removal of such wrench 84 from the drill head 34, a lock mechanism 176, shown in FIGS. 9, 10 and 12, is secured to the upper end of the uppermost quill shaft section 80 and is operated to secure the quill shaft against rotation relative to the drill string. The lock mechanism 176 is quite simple in its construction and includes a tubular socket 178 the lower end of which is provided with threads for engaging threads 180 at the upper end of the uppermost quill shaft section 80. It also includes a friction clamp mechanism which is operable by rotation of a screw 182 for extending and retracting a plurality of friction clamp elements 184. Rotation of screw 182 in one direction causes the elements 184 to move radially outwardly. Rotation of screw 182 in the opposite direction causes the elements 184 to be pulled radially inwardly. The specific mechanism within lock mechanism 176 is not a part of the present invention and for that reason it is not illustrated. However, by way of typical and therefore nonlimitive example, the screw 182 may include a conical portion within the housing of mechanism 176 which is both rotated and moved axially when screw 182 is turned. The clamp elements 184 may include cam surfaces at their inner ends which rest against the surface of the conical portion. Rotation of screw 182 results in both rotation and axial travel of the conical portion. Rotation in the direction which causes the diameter of the surface in contact with the cam surfaces at the inner ends of elements 184 to increase, as the conical portion moves axially, causes the elements 184 to move radially outwardly. Alternatively, rotation of screw 182 may operate a gear mechanism which is arranged to cause elements 184 to move radially outwardly in response to rotation of screw 182 in one direction and to move inwardly in response to its rotation in the opposite direction.

During the time that the drive head 34 and the wrench 84 secured thereto are being rotated for the purpose of turning quill shaft 80, to in that manner set the position of the cutter carrying arms, the upper section of drill pipe 78 is locked to a holding table portion of the drilling machine. In this manner, the portions of the drill string which is in the hole is secured to the drilling machine DM. After the position of the carrying cutter arms has been set, the drill head 34 is reversed for the purpose of unscrewing wrench socket portion 87 from the threaded upper end portion 180 of the upper quill shaft section 80. Then, the cross frame carrying the drill head 34 is raised (e.g. hydraulically) and the wrench 84 is removed from the drill head 34. Next, the lock mechanism 176 is placed onto end 180 and rotated until the clamp elements 184 are located inside of the drill pipe, as shown in FIG. 12. Then, screw 182 is rotated to cause the elements 184 to move radially outwardly and frictionally grip the wall of the upper section of drill pipe. Next, the cross frame is lowered until the threaded box carried by the drill head 34 is in thread starting contact with the threaded pin at the upper end of the upper drill pipe section 78. Then, the drill head 34 is rotated until the threaded connection between such pin and the box within head 34 is right and, thereafter, up drilling is commenced.

The big hole down drilling equipment is used to form a shaft or blind hole, i.e., a hole which does not open into another level or tunnel but rather stops in a closed end. After such a hole has been formed and the boring equipment has been removed from it, a workman may be sent to the region of the closed end for the purpose of setting an explosive charge, the detonation of which will create a room in which the rearmer can be expanded.

In a typical installation, a blind hold is bored generally downwardly, then the down hole boring equipment is removed from the hole, then a room is blasted out at the lower end of the hole, and then the reaming equipment is inserted into the hole and adjusted for reaming. As the reaming is being done the cuttings are allowed to fall into the pilot hole. If the difference in diameter between pilot hole and the enlarged hole is relatively small, there may be enough room behind the reamer to collect all of the cuttings that are formed. However, in some installations, it becomes necessary to retract the reamer and remove it from the ground after it has only partially reamed the pilot hole. Then, a clam shell excavator or the like must be lowered down into the hole and used for picking up the cuttings and removing them to provide room for additional cuttings once the reaming is resumed. Of course, following the reaming operation the clam shell or other type excavator is used for cleaning the cuttings out of the enlarged hole.

What is claimed is:

1. An apparatus for boring a bore hole and reaming it back to a larger diameter comprising:

a rotatable powered drive stem having a diameter substantially less than the diameter of the bore hole;

a stabilizer frame detachably connected to the lower end of said drive stem, said stabilizer frame having peripheral portions extending outwardly a substantial distance beyond said drive stem to contact against the bore wall to center said stabilizer frame within the bore hole;

a bore formed cutterhead and a bore enlarging reamer; and said stabilizer frame further including mounting means for selectively detachably connecting said bore forming cutterhead and said bore enlarging reamer to the side of said stabilizer frame opposite said drive stem, said mounting means having attachment points associated with corresonding points on said cutterhead and said reamer for attaching said cutterhead and reamer to said stabilizer frame, said mounting means attachment points located at substantial distances radially outwardly of said drive stem.

2. An apparatus according to claim 1, wherein said bore forming cutterhead comprises a cutter carrier frame and a plurality of cutters mounted on said cutter carrier frame at different distances radially outwardly from the axis of rotation of said stabilizer frame.

3. An apparatus according to claim 1, wherein said reamer is adjustable from a diameter which is less than the diameter of said stabilizer frame to a diameter that is substantially greater than the diameter of said stabilizer frame.

4. An apparatus according to claim 3, wherein said reamer includes:

a housing which is detachably connectable to said stabilizer frame;

an axially extending guide beam trailing said housing;

a plurality of cutter support arms, each having a leading end portion which is pivotally connected to said housing;

a plurality of cutter arms positioning links, each of which is pivotally connected at one of its ends to a corresponding cutter support arm;

wherein said lead screw means is located within said housing and includes means mounting it for rotation about an axis coincident with the bore hole axis;

means interconnecting said lead screw means and the ends of said cutter arm positioning links opposite said cutter support arms to swing said cutter arm positioning links upon rotation of said lead screw, to in that manner change the angular position of said cutter support arms relative to said housing and in turn change the fly diameter of said reamer.

5. An apparatus according to claim 1, wherein said reamer is adjustable from a diameter which is less than the diameter of said stabilizer frame to a diameter that is substantially greater than the diameter of said stabilizer frame, said reamer including:

a housing which is detachably connectable to said stabilizer frame;

a plurality of cutter support arms each having a leading end portion which is pivotally connected to said housing;

a plurality of cutter arm positioning links, a first end portion of each of said cutter arm positioning links being pivotally connected to a corresponding cutter support arm; and activating means pivotally connected to the second end portion of each of said cutter arm positioning links to shift said cutter arm positioning link second end portions substantially parallel of the length of said drive stem to thereby swing said cutter arm positioning links to in that manner change the angular position of said cutter support arms relative to said housing and in turn change the fly diameter of said reamer.

6. The apparatus according to claim 5, wherein said actuating means includes:

an axially extending guide beam trailing said housing;

a sliding member adapted to travel axially along said guide beam, said sliding member pivotally connected to the second end portions of each of said cutter arm positioning links; and means disposed within said housing for sliding said sliding member along said guide beam to thereby swing said cutter arm positioning links to in that manner change the angular position of said cutter support arms relative to said housing to thereby change the fly diameter of said reamer.

7. An apparatus according to claim 1, wherein said stabilizer frame includes a plurality of bore wall engaging rollers disposed about the periphery of said stabilizer frame.

8. An apparatus according to claim 3, wherein:

said reamer includes elongate lead screw means which is rotatable for changing the diameter of said reamer, said lead screw means extending longitudinally from said drive stem;

further comprising coupler means attached to the end portion of said lead screw means adjacent said drill stem; and said drill stem includes a rotatable drive rod means therein which is connectable to said coupler means and which is operable when rotated to turn said lead screw means to change the diameter of said reamer.

* * * * *